United States Patent [19]

Wakatsuki et al.

[11] Patent Number: 5,048,306

[45] Date of Patent: Sep. 17, 1991

[54] REFRIGERATOR

[75] Inventors: Yuji Wakatsuki; Shigekazu Kondo; Mitsuyuki Takaoka; Nobuya Suzuki, all of Toyaoke, Japan

[73] Assignee: Hoshizaki Denki Kabushiki Kaisha, Aichi, Japan

[21] Appl. No.: 540,352

[22] Filed: Jun. 19, 1990

[51] Int. Cl.[5] ..... F25D 17/06

[52] U.S. Cl. ..... 62/419; 62/441

[58] Field of Search ..... 62/419, 441

[56] References Cited

U.S. PATENT DOCUMENTS

| | | | |
|---|---|---|---|
| 2,775,873 | 1/1957 | Jones | 62/419 X |
| 3,466,891 | 9/1969 | Maxwell | 62/419 |
| 3,866,437 | 2/1975 | Spencer | 62/419 X |

*Primary Examiner*—Lloyd L. King

*Attorney, Agent, or Firm*—Koda and Androlia

[57] ABSTRACT

There is disclosed a refrigerator comprising a first passage defined in a space in the interior of a heat-insulating box to guide cold air from a evaporator downwardly, and a second passage which guides the cold air that has flowed downwardly in the first passage and rises to return to the evaporator, a partition plate which is disposed within the first passage to divide the passage into a passage which communicates the first passage with the second passage in order to allow the flow of the cold air in contact with the upper storage box, and a passage communicating with the second passage, allowing the cold air to flow into the upper storage box out of contact with the upper storage box; a regulating means which is disposed in a cold air passage from the evaporator, and regulates the flow of the cold air into the passage; and a cold air introducing means disposed in the passage. The cold air introducing means is operated to allow a part of the cold air from the evaporator to flow into the passage without being regulated by the regulating means.

4 Claims, 8 Drawing Sheets

REFRIGERATOR

BACKGROUND OF THE INVENTION

1. Field of the Invention:

The present invention relates to a refrigerator containing a plurality of storage boxes vertically arranged, with prescribed space provided in a heat-insulating box and, more particularly, a refrigerator capable of separately controlling a storage temperature of each of the storage boxes.

2. Description of the Prior Art:

When preserving vegetables, fruit, meat, fish and other perishable foods (hereinafter referred to as the "foods") for a prolonged period of time at temperatures near freezing point in a refrigerator, or gradually thawing frozen foods, it is generally necessary to restrain a change in the refrigerator storage temperature as little as possible and to control to restrain the evaporation of water content from the foods.

In order to meet this need, there is preferably adapted a refrigerator of such a double-walled structure that storage boxes for storing foods are formed, through a required space defined between this heat-insulating box and the storage boxes, within a heat-insulating box which forms a refrigerating chamber, and a cold air is circulated from a evaporator into the space, thereby cooling the storage boxes.

The optimum refrigerating temperature differs with the kind of the foods, such as vegetables, fruit, meat and fish to be stored. Namely, for the prolonged preservation of the foods without deteriorating their freshness, it is essential to store the foods at their optimum refrigerating temperature. For this purpose, a plurality of storage boxes are formed in the heat-insulating box of the refrigerator of the double-walled structure, and each of the storage boxes is cooled to different storage temperature through a refrigeration system corresponding thereto, thereby enabling the most suitable storage of different kinds (the optimum refrigerating temperature varies) of the foods.

In this case, the refrigerator requires as many refrigeration systems as the storage boxes provided therein. This, however, has the drawback that the use of a large refrigerator including a larger number of storage parts will be demanded, resulting in a higher manufacturing cost. Moreover, there is such a drawback that because of the operation of a plurality of refrigeration systems, power consumption will increase.

OBJECT OF THE INVENTION

In view of the above-described drawbacks inherent in the heretofore known refrigerators of double-walled structure which contain a plurality of storage boxes inside of the aforementioned heat-insulating box, it is an object of the present invention to provide a low-cost refrigerator which is designed to perform respective temperature control of the storage boxes.

SUMMARY OF THE INVENTION

The present invention has been accomplished in an attempt to resolve the problems mentioned above and attain the object by providing a refrigerator having a heat-insulating box which has a plurality of opening sections and a heat-insulated door provided at each of the opening sections; a plurality of storage boxes disposed vertically through a prescribed space within the heat-insulating box, and having opening sections open correspondingly to the aforesaid opening sections; and a evaporator disposed on the upper storage box in the heat-insulating box, the refrigerator, comprising: a first passage which is defined in a space in the interior of the heat-insulating box to guide cold air from the evaporator downwardly, and a second passage which guides the cold air that has flowed, downwardly in the first passage, returning to the evaporator; a partition plate which is disposed within the first passage to divide the passage into a passage which communicates the first passage with the second passage in order to allow the flow of the cold air in contact with the upper storage box, and a passage communicating with the second passage, allowing the cold air to flow into the upper storage box without contacting the upper storage box; a regulating means which is disposed in a cold air passage from the evaporator, and regulates the flow of the cold air into the passage; and a cold air introducing means disposed in the passage, the cold air introducing means being operated to let a part of the cold air from the evaporator flow into the passage without being regulated by the regulating means.

According to the refrigerator of the present invention, as explained above, the passage for cooling the upper storage box and the passage for flowing the cold air for cooling the lower storage box are separately defined, and the cold air introducing means is operated to flow the cold air into the cold air passages to cool the lower storage box. It is, therefore, possible to separately cool the storage boxes by controlling the operation of the cold air introducing means. That is, the storage temperature of the storage boxes can be separately controlled. This storage alone, therefore, can preferably store a plurality of foods to be preserved at different optimum storage temperatures. In addition, since only one refrigeration system is sufficient, manufacturing cost can be lowered and power consumption decreased.

DETAILED DESCRIPTION OF THE INVENTION

Hereinafter preferred embodiments of the refrigerator according to the present invention will be described with reference to the accompanying drawings.

Figure 1:
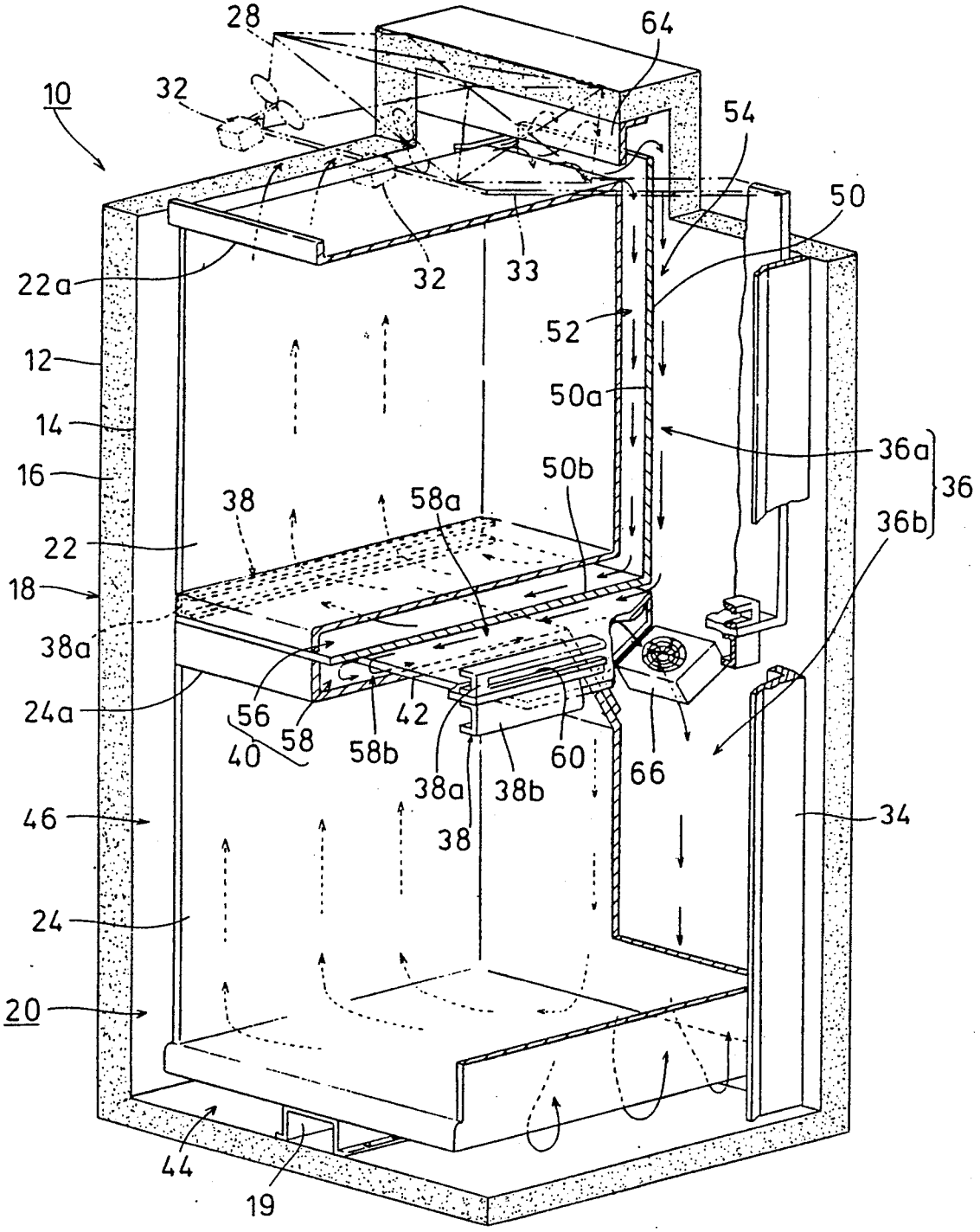
FIG. 1 is a partly longitudinal sectional perspective view showing a part of an upright refrigerator according to a preferred embodiment of the present invention.
Figure 2:
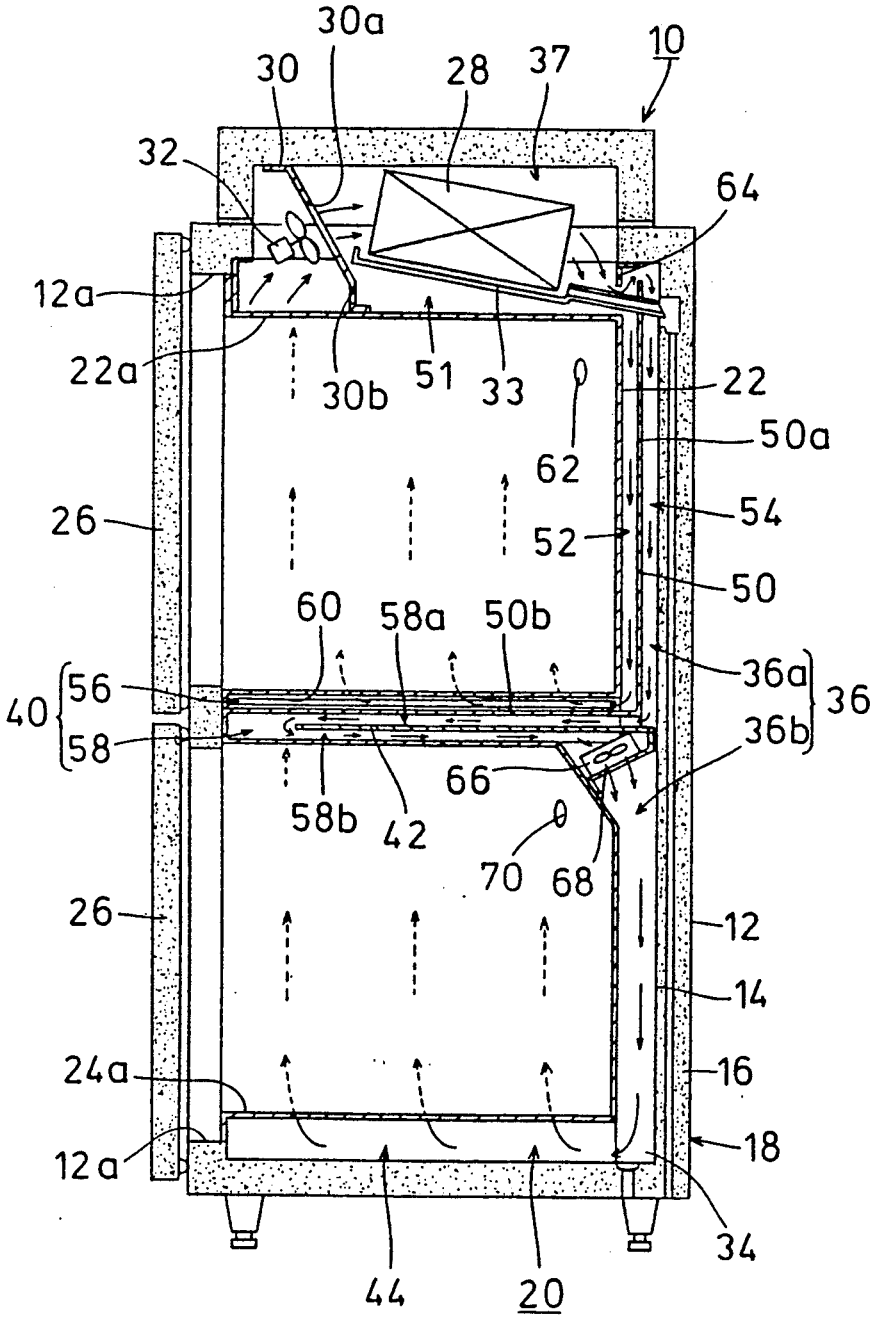
FIG. 2 is a longitudinal sectional side view of the refrigerator shown in FIG. 1.

FIG. 1 is a perspective view showing an upright refrigerator, partly longitudinally sectioned, according to a preferred embodiment of the present invention. FIG. 2 is a longitudinal sectional side view of the refrigerator shown in FIG. 1. And FIG. 3 is a longitudinal sectional front view of the refrigerator shown in FIG. 1.

As shown in these drawings, a refrigerator 10 has an outer box 12 having square opening sections 12*a*, 12*a* which are vertically arranged with a prescribed amount of spacing provided therebetween and are widely open at the front side, an inner box 14 installed in this outer box 12 with a prescribed amount of space provided therebetween and widely open also at the front side, and a heat-insulating material 16, such as foamed urethane, filled in between these boxes 12 and 14. In the inner box 14 of this heat-insulating box 18 are vertically arranged the upper storage box 22 and the lower storage box 24 through a heat-shielding member 38, 38 which will be described later on with its inner wall 20 and a required space 20 provided The storage boxes 22 and 24 have square opening sections 22*a* and 24*a* which are open at the front correspondingly to the square opening sections 12*a* and 12*a* formed in the heat-insulating box 18. At the front of the heat-insulating box 18 is installed a heat-insulated door 26 correspondingly to each opening section 12*a* of the heat-insulating box 18 as shown in FIG. 2, and freely opens and closes this opening section 12*a*. The storage boxes 22 and 24 are produced of a heat-conduction metal sheet, such as a stainless steel.

Figure 3:
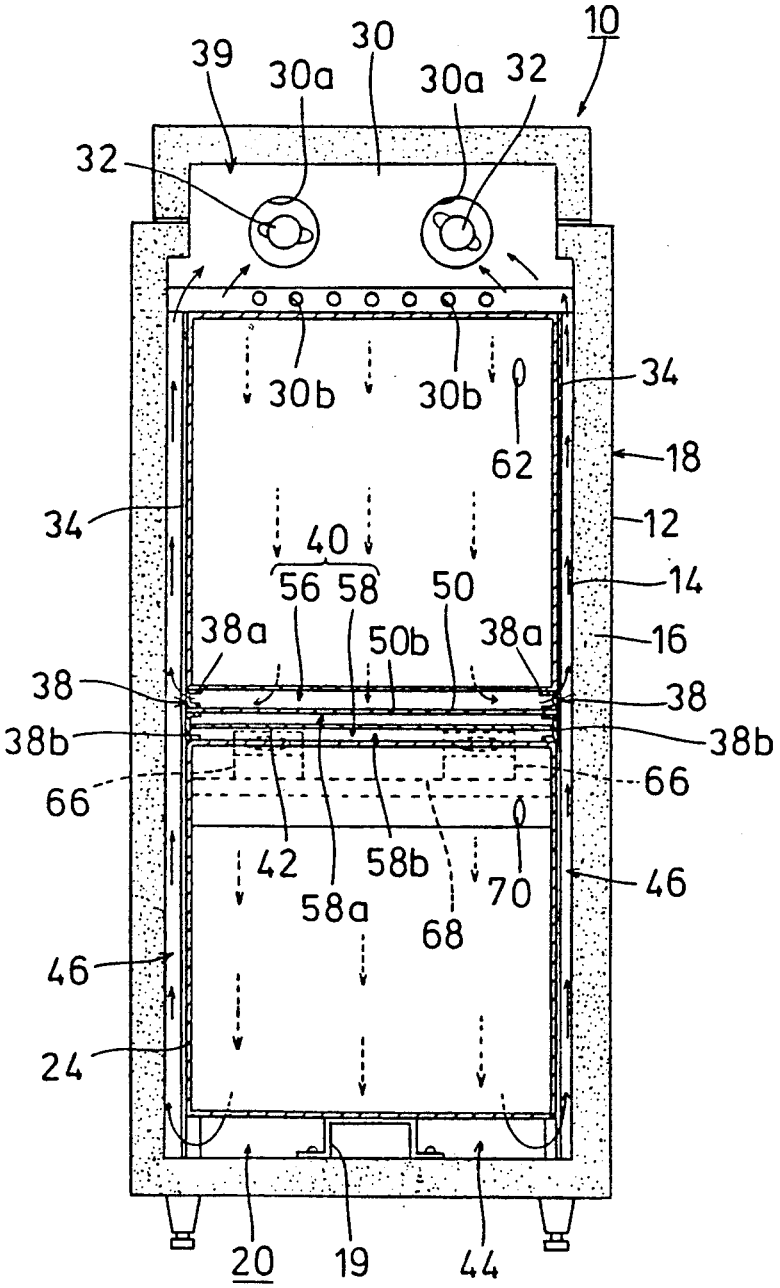
FIG. 3 is a longitudinally sectional front view of the refrigerator shown in FIG. 1.
Figure 4:
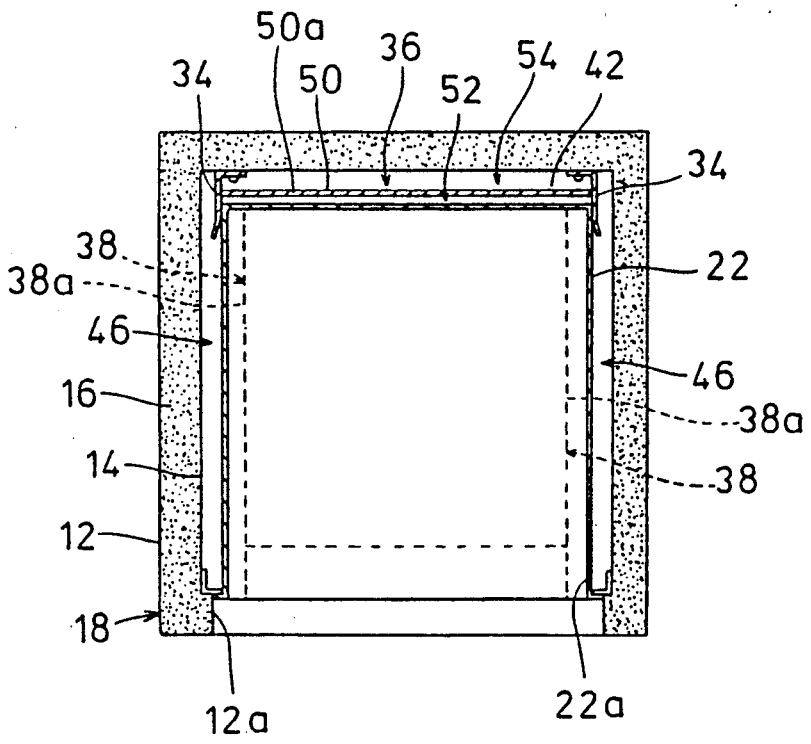
FIG. 4 is a cross-sectional plan view of the refrigerator shown in FIG. 1.

At the inside bottom of the inner box 14, as shown in FIG. 3, is attached a support member 19 which projects out upwardly to a prescribed height from the bottom surface at the center of the bottom in the direction of width thereof. On this support member 19, the lower storage box 24 is mounted, providing a bottom space 44 between the lower storage box 24 and the bottom of the inner box 14. On the inside back surface of the inner box 14, as shown in FIG. 4, a pair of storage box guides 34, 34 of L section are opposingly installed, apart from each other by the size of width of the storage box 22. These guides 34, 34 are vertically installed for nearly the overall length of the inside space of the inner box 14. Between the guides 34, 34, the back of the storage boxes 22 and 24 are commonly fitted.

Between the back of the storage boxes 22 and 24 and the storage box guides 34, 34 and the inside wall of the inner box 14, as described later, there is provided a back passage 36 which functions as the first passage for guiding the cold air downwardly to cool the storage boxes 22 and 24. The back passage 36 is divided by a partition 42, which is described later on, into an upper back passage 36*a* located on the back side of the upper storage box 22 and a lower back passage 36*b* located on the back side of the lower storage box 24. Furthermore, the width of the storage boxes 22 and 24 is set smaller than the inside dimension of the inner box 14, thereby defining, as shown in FIG. 4, side passages 46, 46, which function as the second passage for guiding the cold air upwardly to cool the storage boxes 22 and 24, on both sides of the storage boxes 22 and 24. Namely, the space 20 formed between the inside wall of the inner box 14 and the outside wall of the storage boxes 22 and 24 is constituted of the back passage 36, the bottom space 44 and the side passages 46, 46.

The space provided between the inside ceiling surface of the inner box 14 and the ceiling surface of the upper storage box 22 is separated into two chambers 37 and 39 by a partition wall 30 as shown in FIG. 2. In the first chamber 37 communicating with the back passage 36 is mounted a evaporator 28 which communicates with a refrigeration system not illustrated and circulates refrigerant from the refrigeration system to a built-in evaporator. This refrigeration system is set such that refrigerator operation will be controlled on the basis of a temperature sensed by a temperature sensor 62 mounted inside of the upper storage box 22.

The second chamber 39 communicates with the side passages 46, 46. In this chamber 39 are installed fans 32 in positions corresponding to a plurality of openings 30*a* (two in this embodiment) which are provided in the partition wall 30. This fan 32 is disposed so as to blow the air towards the first chamber 37; therefore, driving the fan 32 draws the air from the side passages 46, 46, which then comes in contact with the evaporator 28 through the opening 30*a*, thus becoming cold air to be blown out into the back passage 36.

At the bottom of the condenser 28 mounted in the first chamber 37, as shown in FIG. 2, a drip tray 33 is set to discharge water dripping from the evaporator 28 out of the refrigerator. Between the bottom of this drip tray 33 and the ceiling surface of the upper storage box 22, a cold air passage 51 is formed for the circulation of a part of the cold air from the evaporator 28 in this cold air passage 51. The partition wall 30 has a plurality of holes 30*b* drilled in positions corresponding to the cold air passages 51, so that the cold air partly circulating in the cold air passage 51 through the holes 30*b* may be led into the second chamber 39.

On both the right and left side edges in the upper and lower opposing surfaces of the upper storage box 22 and the lower storage box 24, as shown in FIGS. 1 to 3, shield members 38, 38 are opposingly inserted extending nearly for the entire length in the direction of depth of the storage box 22 (24), these shield members 38, 38 forming a horizontal passage 40 of a required dimension between the upper and lower opposing surfaces of the storage boxes 22 and 24. This horizontal passage 40 closed at the front and at both sides, as shown in FIG. 2, communicates only with the back passage 36 in order to introduce the cold air flowing downwardly in the back passage 36. That is, the horizontal passage 40, together with the back passage 36, forms the second passage in which the cold air flows downwardly.

The shield member 38, as illustrated, consists of a -shaped first shield plate 38*a* and a second shield plate 38*b*, both of which are installed with a partition plate 50 inserted therebetween. The first shield plate 38*a* is provided with holes 60 drilled for communication with the side passage 46, flowing the cold air that has entered the upper passage 56 formed in the horizontal passage 40, out into the side passage 46 as described later on.

In the upper back passage 36*a* on the back side of the upper storage box 22 and the horizontal passage 40, the partition plate 50 having an inverted L section is commonly inserted as shown in FIG. 2, separating the passages 36*a* and 40 double. Namely, the vertical part 50*a* of the partition plate 50 is inserted in the upper back passage 36*a*. This upper back passage 36*a* is separated with the vertical section 50 into a first cold air passage 52 which guides the cold air in contact with the back of the upper storage box 22 and a second cold air passage 54 which guides the cold air out of contact with the upper storage box 22. Also, the horizontal section 50*b* of the partition plate 50, with its right and left ends held between the first shield plate 38*a* and the second shield plate 38*b*, extends as far as the front end of the horizontal passage 40, separating the horizontal passage 40 into an upper passage 56 communicating with the first cold air passage 52 and a lower passage 58 communicating with the second cold air passage 54.

By the way, it is advised that the partition plate 50 be produced of a low heat-conductive material so that the storage boxes 22 and 24 will be subjected to thermal effect each other. Also, as a means for preventing the thermal effect between the storage boxes 22 and 24, the partition plate 50 may be lined with a heat-insulating material.

Figure 5:
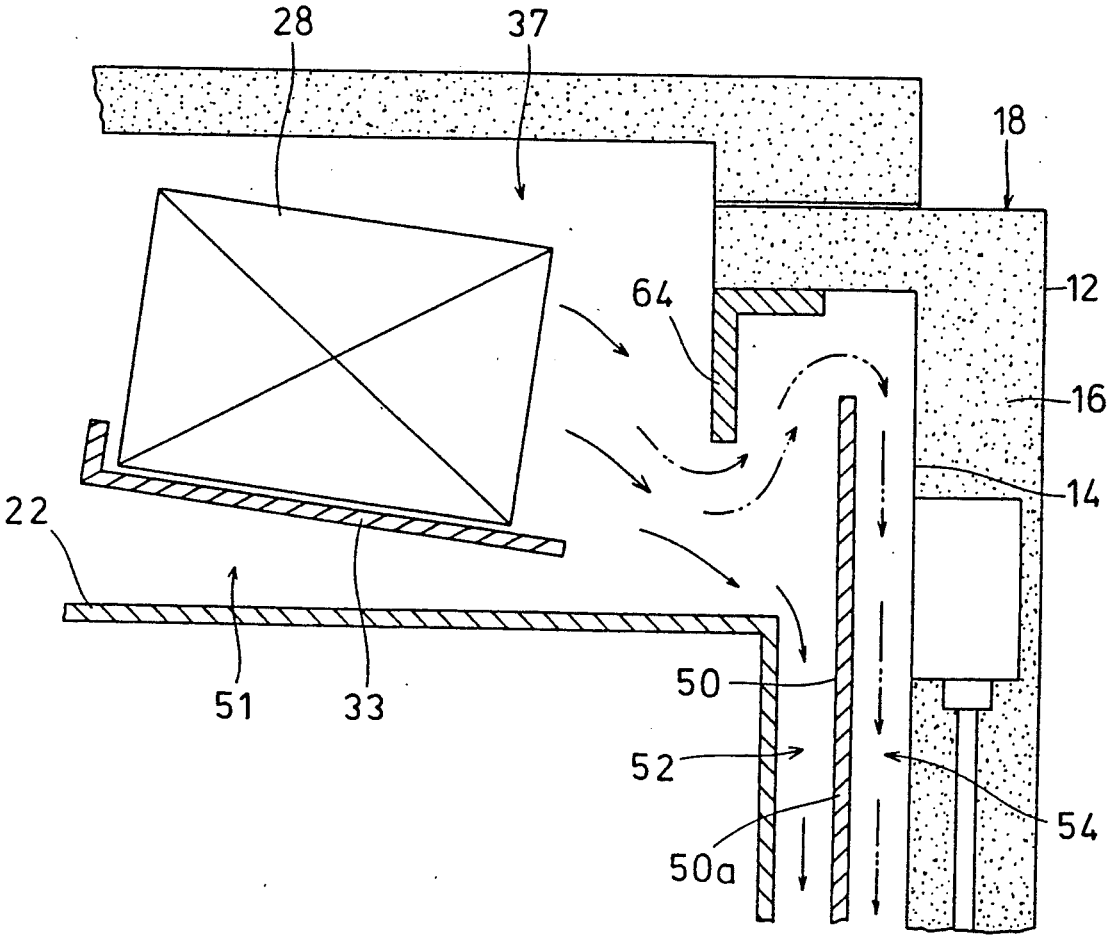
FIG. 5 is a longitudinally sectional side view, on an enlarged scale, of a major portion showing the upper part of the refrigerator.

The top end of the vertical part 50*a* of the partition plate 50 projects upwardly only by a required length above the ceiling surface of the storage box 22, and into the first chamber 37 as shown in FIG. 5. Between the condenser 28 and the vertical part 50*a* is disposed a restriction plate 64 as a restricting means extending downwardly from the ceiling surface of the inner box 14 by a prescribed length and throughout the entire length, in the direction of width, of the inner box 14, parallelly with the vertical part 50*a*. The lower end of this restriction plate 64 is set at a level below the top end of the vertical part 50*a*, so that the cold air coming out from the condenser 28 will never enter the second cold air passage 54 except when the fan motor 66 described later is not operating.

Therefore, the cold air flowing out from the condenser 28 towards the back passage 36 goes only into the first cold air passage 52. This cold air, thus flowing downwardly in the first cold air passage 52 to cool the back of the upper storage box 22, flows into the upper passage 56, where the cold air cools the bottom of the upper storage box 22. Also the cold air that has entered the upper passage 56 flows out into the side passages 46, 46 through the holes 60, 60 drilled in the first shield plate 38*a*, 38*a*, going upwardly in the side passages 46, 46 while cooling both sides of the upper storage box 22 and returning into the condenser 28. In this manner the refrigeration cycle is repeated to cool only the upper storage box 22. The storage temperature control of the upper storage box 22 is effected by stopping the operation of the refrigeration system when the temperature sensor 62 has sensed a preset temperature as described above.

On the inner wall of the horizontal passage 40 in the inner box 14 which faces the lower passage 58, as shown in FIGS. 2 to 6, the partition 42 is projectingly installed in parallel with the horizontal section 50*b* of the partition plate 50, dividing the lower passage 58 into an upper circulation path 58*a* and a lower circulation path 58*b*. The back passage 36 also is separated, by the same partition 42, into two passages: an upper back passage 36*a* and a lower back passage 36*b*, such that, as described later, the flow of the cold air which is flowing downwardly in the second cold air passage 58, is diverted by the partition 42 toward the lower passage 58. The outside diameter of this partition 42 has been set, as shown in FIG. 3, so that both sides of the second shield plates 38*b*, 38*b* come in contact with each other and that there is provided a gap of prescribed dimension communicating between the upper circulation path 58*a* and the lower circulation path 58*b* at the projecting end side.

Therefore, it is possible to distribute the cold air flowing downwardly in the second cold air passage 54, throughout the ceiling surface of the lower storage box 24 through the partition 42 as described later, thereby improving the cooling efficiency of the storage box 24. The provision of the partition 42 is not an essential requirement of the present invention; the object of this invention can preferably be accomplished without the partition 42.

Figure 6:
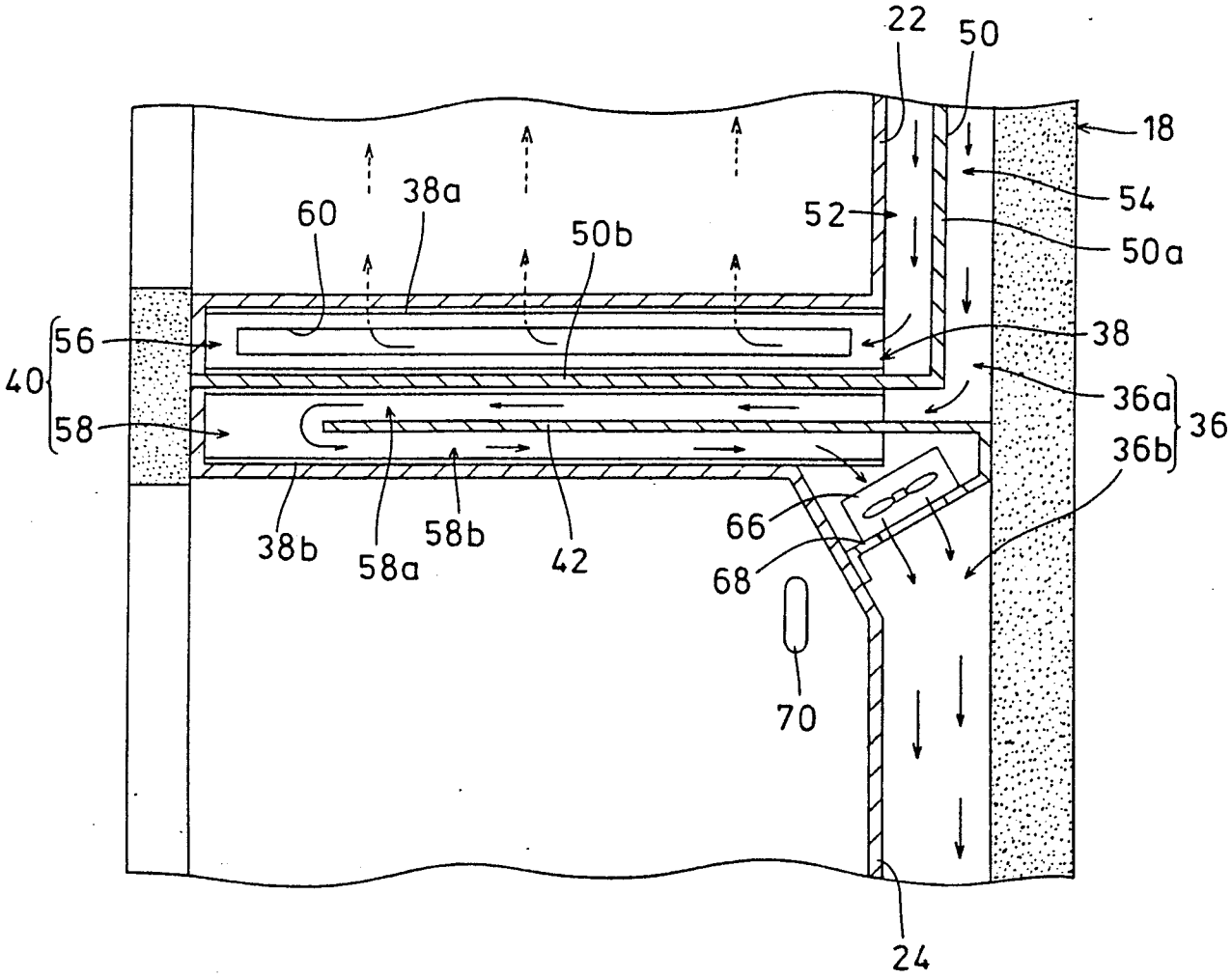
FIG. 6 is a longitudinally sectional side view of a major portion showing the upper and lower opposing sections of storage boxes.

In the lower back passage 36*b* located below the partition 42 is mounted a fan motor 66 as a means for introducing the cold air through the mounting bracket 68 as shown in FIG. 6. This fan motor 66 is so set as to blow out the air that has been drawn in from the lower circulation path 58*b*, into the lower back passage 36*b* side. That is, when the fan moror 66 is driven, a negative pressure is built up in the lower passage 58 and the second cold air passage 54 by which the cold air coming from the condenser 28 is partly drawn into the second cold air passage 54 over the top end of the vertical part 50*a* of the partition plate 50, going around the lower end of lower restriction plate 64.

The cold air flowing downwardly in the second cold air passage 54 strikes the partition 42, going into the upper circulation path 58*a* of the lower passage 58. From the forward end of this partion 42, the cold air flows through the lower circulation path 58*b*, then being blown out into the lower back passage 36*b* via the fan motor 66. Also, the cold air currents flowing into the lower back passage 36*b* go downwardly in contact with the back of the lower storage box 24, as shown in FIG. 3, being blown out into the bottom space formed under the bottom of the lower storage box 24. Thence the cold air rises in the side passages 46, 46 which communicate with the bottom space 44, while cooling each of the storage boxes 22 and 24, repeating the cycle to return to the evaporator 28.

Namely, the lower storage box 24 is cooled only when the fan motor 66 is driven, and therefore it is possible to cool the upper storage box 22 and the lower storage box 24 separately. The operation of the fan motor 66 is controlled in accordance with the temperature sensed by the temperature sensor 70 disposed in the lower storage box 24, thereby maintaining a constant storage temperature of the storage box 24.

Figure 7:
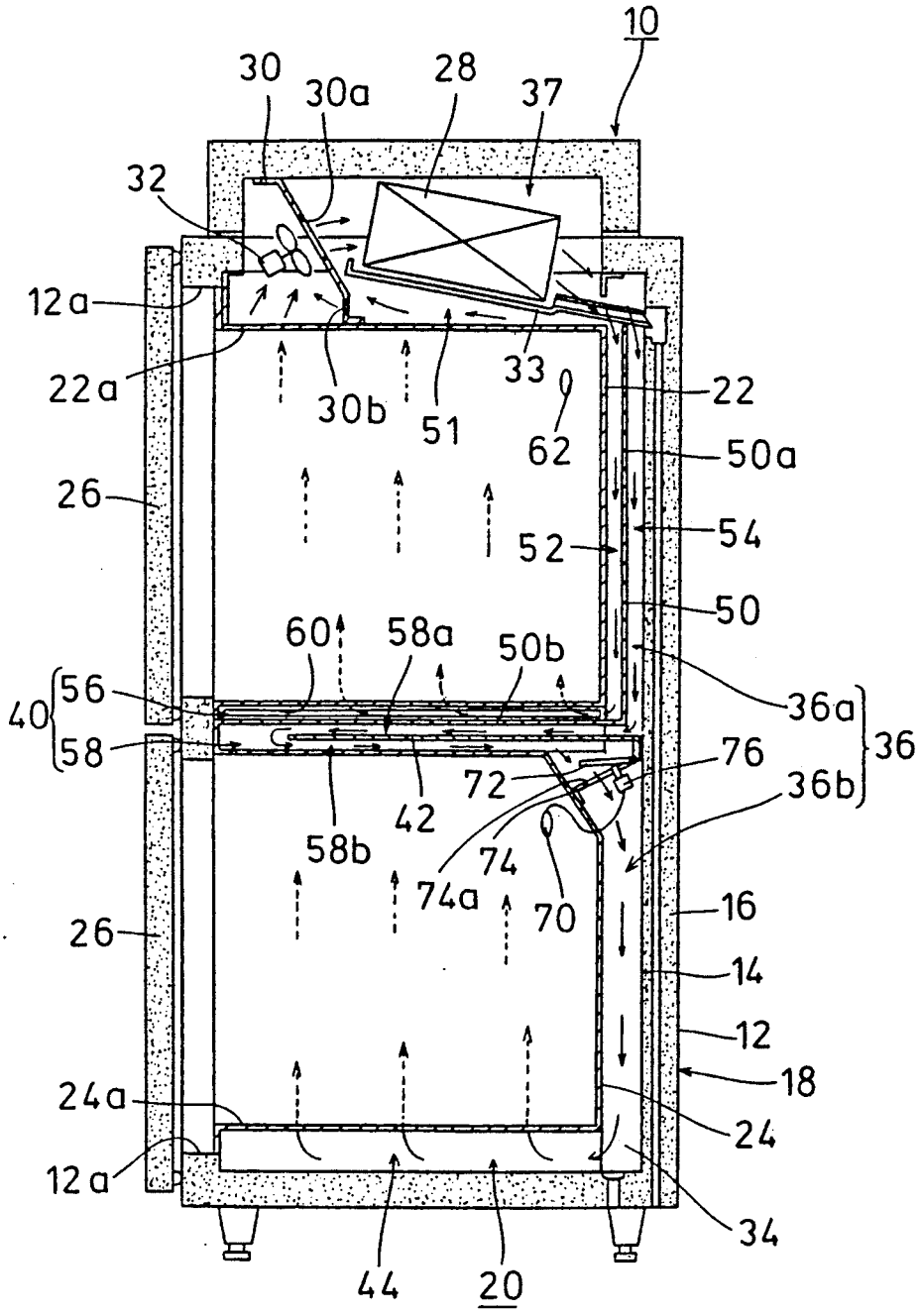
FIG. 7 is a longitudinally sectional side view of a refrigerator according to another embodiment of the present invention.
Figure 8:
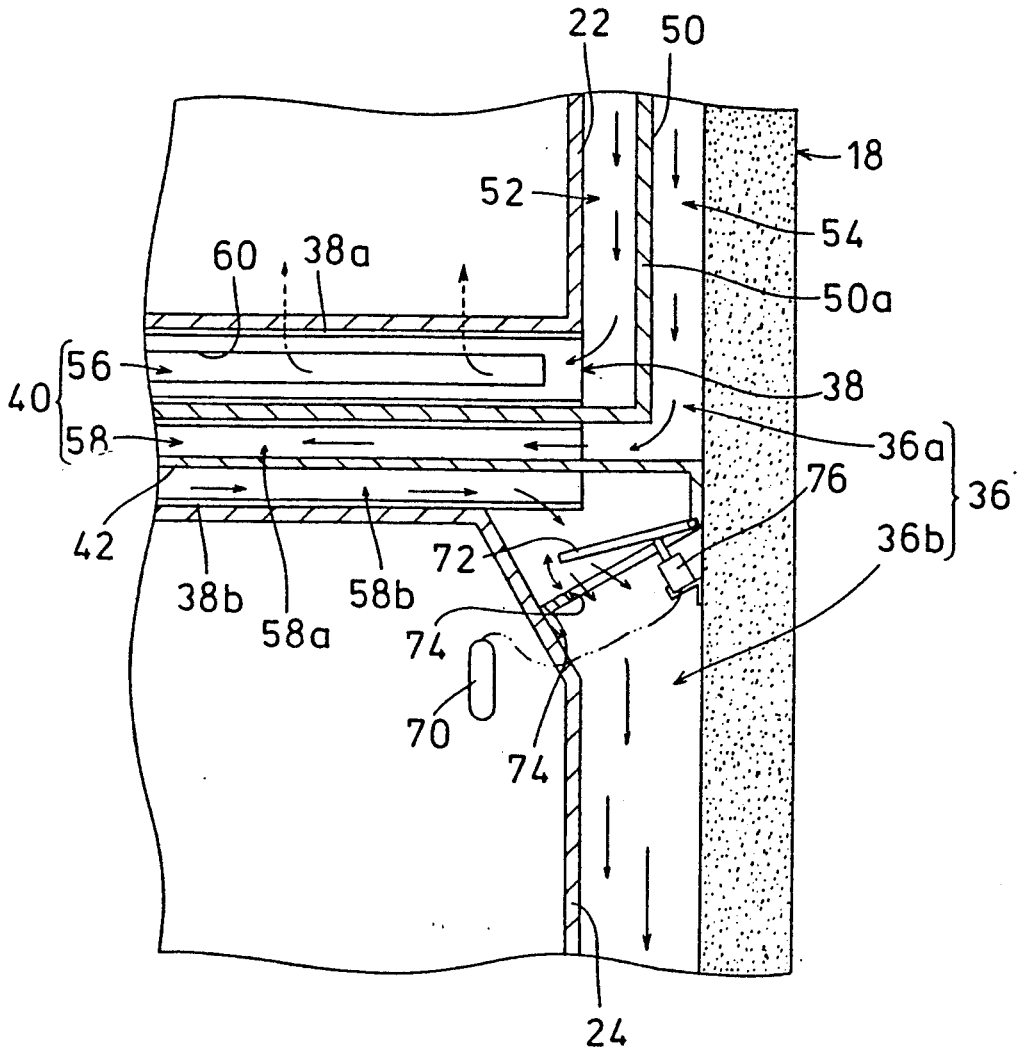
FIG. 8 is a longitudinally sectional side view of a major portion showing a damper mounting section, in an enlarged section, shown in FIG. 7.

Next, FIGS. 7 and 8 show another embodiment of the refrigerator of the present invention, wherein a damper 72 is used as a means for controlling the storage temperature of the lower storage box 24.

As shown in FIG. 7, the top end of the vertical part 50*a* of the partition plate 50 is set so as to be positioned nearly at the same level as the ceiling surface of the upper storage box 22, such that the cold air from the evaporator 28 is branched off into the first cold air passage 52 and the second cold air passage 54. Below the partition 42 is located the lower back passage 36*b*, in which a barrier plate 74 is disposed as a regulating means capable of shutting off the cold air currents in the lower back passage 36*a* and the lower circulation path 58*b*, between the outer wall of the lower storage box 24 and the inner wall of the inner box 14. This barrier plate 74, as shown in FIG. 8, is provided with an opening 74*a* of a required size in a suitable position, and with a damper 72 as a means for introducing the cold air by freely opening and closing this opening 74*a*.

Furthermore, beneath the damper 72, there is disposed an actuator 76 which controls the opening and closing operation and the amount of opening of the damper 72. This actuator 76 is designed to be controlled in accordance with a temperature sensed by the temperature sensor 70 mounted in the lower storage box 24. Therefore the actuator 76 is driven on the basis of the temperature sensed by the temperature sensor 70; when the damper 72 is opened, the lower circulation path 58*b* and the lower back passage 36*b* open to each other through the opening 74*a*, admitting the cold air to go around the lower storage box 24.

Function of Embodiment

Next, the operation of the refrigerator according to the embodiment will be explained. First, to cool only the upper storage box 22 of the refrigerator according to the embodiment shown in FIG. 1, the refrigerator is operated with the fan motor 66 kept at a stop. The air in the storage compartments on the side passages 46, 46 side is drawn in by the fan 32, being sent into the evaporator 28 through the opening 30*a* in the partition wall 30. In this evaporator 28, the air is cooled by the heat exchanger, then being blown out into the back passage 36. The cold air from the condenser 28 partly circulates in the cold air passage 51 formed between the drip tray 33 and the ceiling surface of the upper storage box 22, accomplishing a so-called short cycle to cool the ceiling surface of the storage box 22.

The cold air coming into the back passage 36, as shown in FIG. 5, is retricted by the restriction plate 64 and the vertical part 50*a* of the partition plate 50, flowing all into the first cold air passage 52. The cold air that has entered the first cold air passage 52 flows downwardly in contact with the back of the upper storage box 22, striking the horizontal section 50*b* of the partition plate 50 and being diverted to flow into the upper passage 56. The cold air that has entered the upper passage 56 flows in contact with the bottom of the upper storage box 22 for heat exchange and then goes out into the side passages 46, 46 through the holes 60, 60 drilled in the first shield plates 38*a*, 38*a*.

The cold air that has flowed out into the side passages 46, 46, being warmed (as compared with the cold air at the outlet of the evaporator 28) by heat exchange with the upper storage box 22, goes upwardly in the side passages 46, 46 in contact with both sides of the upper storage box 22 for heat exchange, then returning into the evaporator 28 to repeat the cycle.

With the repetition of cold air recirculation, the storage temperature in the upper storage box 22 gradually lowers. When this storage temperature has reached a preset temperature of the temperature sensor 62, the temperature sensor 62 senses it, stopping the operation of the refrigeration system to always maintain the storage temperature above a preset temperature. When the cold air circulation has stopped and the storage temperature has increased to a required temperature range, this temperature rise is sensed by the temperature sensor 62, which starts the refrigeration system again, thereby constantly keeping the storage temperature by cooling the upper storage box 22.

Next, when cooling the storage boxes 22 and 24, the fan motor 66 disposed below the partition 42 is driven, thus building up a negative pressure in the second cold air passage 54 and the lower passage 58. As a result of the establishment of this negative pressure in the second cold air passage 54, a part of the cold air delivered from the evaporator 28 goes round under the restriction plate 64 and over the top end of the vertical part 50*a*, flowing into the second cold air passage 54. Furthermore, since a part of the cold air flows into the first cold air passage 52, the cold air circulates around the upper storage box 22 similarly as described above, cooling the storage box 22.

The cold air branched off into the second cold air passage 54 flows downwardly to the position of the partition 42 without effecting the heat exchange with the upper storage box 22, and strikes this partition 42, being changed in the direction of flow. After flowing downwardly along the partition 42 in the upper and lower circulation paths 58*a* and 58*b* of the lower passage 58, this cold air is fed out into the lower back passage 36*b* located below the partition 42 through the fan motor 66. At this time, the cold air flows in contact with the ceiling surface of the lower storage box 24, making heat exchange, but not in contact with the bottom of the upper storage box 22, thereby efficiently cooling the lower storage box 24.

The cold air that has entered the back passage 36 again flows downwardly in contact with the back of the lower storage box 24 for heat exchange, then being blown out into the bottom space 44. Here, the cold air comes in contact with the bottom of the storage box 24. Furthermore, when rising in the side passages 46, 46, the cold air comes in contact with both sides of the storage boxes 22 and 24 to cool these storage boxes 22 and 24, then returning to the evaporator 28 again to repeat the refrigeration cycle. Since the cold air that has entered the bottom space 44 is warm as a result of heat exchange with the lower storage box 24, the cold air will not accumulate at the bottom of the heat-insulating box 18, but efficiently circulates. When the cold air repeatedly circulating around the lower storage box 24 has lowered the storage temperature of the storage box 24 as low as the preset temperature, the temperature sensor 70 senses it, thereby stopping the fan motor 66. Therefore, no negative pressure will be built up in the second cold air passage 54 and the lower passage 58 and accordingly the cold air delivered out from the evaporator 28 flows only into the first cold air passage 52. In this stage, the lower storage box 24 comes to be not cooled. Also, when the cold air circulation to around the upper storage box 24 has stopped to raise the storage temperature of the storage box 24 to the prescribed temperature range, the temperature sensor 70, sensing this temperature rise, produces a signal to restart the fan motor, thus enabling restarting the circulation of the cold air to around the lower storage box 24 in order to maintain a constant storage temperature.

In this embodiment, the refrigerator is set to stop the refrigeration system when the storage temperature of the upper storage box 22 has lowered to the preset temperature. When cooling the storage boxes 22 and 24, therefore, it is necessary to determine the preset temperature of the temperature sensor 62 installed in the upper storage box 22 lower than that of the temperature sensor 70 disposed in the lower storage box 24.

Because the upper storage box 22 and the lower storage box 24 can be cooled separately by controlling the operation of the fan motor 66, it is possible to separately control the storage temperature of the storage boxes 22 and 24. Furthermore, the refrigerator according to the present invention has such an advantage that since the cold air can be distributed in contact with the whole bottom surface of the upper storage box 22 and the whole ceiling surface of the lower storage box 24, the cooling efficiency of the upper and lower storage boxes 22 and 24 and the time required to cool the storage boxes 22 and 24 to the preset temperature can be decreased, thereby enabling lowering the running cost.

Next, when the refrigerator according to this embodiment shown in FIG. 6 is operated to cool the upper storage box 22 alone, the refrigerator is operated with the damper 72 fully closed. With the damper 72 fully closed, the air flow between the lower circulation path 58*b* and the lower back passage 36*b* beneath the partition 42 is checked. Therefore, the cold air coming from the evaporator 28 flows into the first cold air passage 52 without going into the second cold air passage 54. The cold air that has entered the first cold air passage 52, similarly to the embodiment shown in FIG. 1, repeats circulation for cooling the upper storage box 22, lowering the storage box 22 temperature to the preset temperature.

Next, to cool the lower storage box 24, the actuator 76 is operated to open the damper 72, as shown in FIG. 8, communicating the lower circulation path 58*b* with the lower back passage 36*b* through the opening 74*a* of the barrier plate 74. Therefore, the cold air coming from the evaporator 28 is branched off to flow into the first and second cold air passages 52 and 54. Then, the cold air that has flowed into the second cold air passage 54 circulates around the lower storage box 24, cooling the storage box 24 to the preset temperature. After the lower storage box 24 is cooled down to the preset temperature, the actuator 76 is controlled by the temperature sensor 70, thereby controlling the opening of the damper 72 to control the flow rate of the circulating cold air and accordingly keeping a constant storage temperature.

What is claimed is:

1. A refrigerator having a heat-insulating box which has a plurality of opening sections and a heat-insulated door provided at each of said opening sections; a plurality of storage boxes disposed vertically through a prescribed space within said heat-insulating box, and having opening sections open correspondingly to said opening sections; an evaporator disposed on said upper storage box in said heat-insulating box, said refrigerator, comprising: first and second passages which are defined in a space in the interior of said heat-insulating box, said first passage for guiding cold air blown out from said evaporator downwardly, and said second passage for upwardly guiding the cold air that has flowed downwardly in said first passage to return to said evaporator; a partition plate which is disposed within said first passage to divide said passage into a passage which communicates said first passage with said second passage in order to allow the flow of the cold air in contact with said upper storage box, and a passage communicating with said second passage, allowing the cold air to flow into said upper storage box out of contact with said upper storage box; a regulating means which is disposed in a cold air passage from said evaporator, and regulates the flow of said cold air into said passage; and a cold air introducing means disposed in said passage, said cold air introducing means being operated to let a part of the cold air from said evaporator to flow into said passage without being regulated by said regulating means.

2. A refrigerator as claimed in claim 1, which further has a restriction plate disposed between a top end section projecting upwardly from the ceiling surface of said upper storage box in said partition plate and said evaporator, and regulating the inflow of the cold air delivered out from said evaporator into said passage; and a fan motor mounted in said passage, said fan motor being driven to draw a part of the cold air delivered out from said evaporator into said passages after going around said restriction plate.

3. A refrigerator as claimed in claim 1, which further has a shield plate which is disposed in said passage to shut off the cold air currents in said passage; and a damper capable of openably closing an opening provided in said shield plate, said damper being opened by a suitable driving means to flow the cold air into said passage.

4. A refrigerator as claimed in claim 1, wherein said partition plate is produced of a material of low heat conductivity.

* * * * *

UNITED STATES PATENT AND TRADEMARK OFFICE

CERTIFICATE OF CORRECTION

PATENT NO. : 5,048,306

DATED : September 17, 1991

INVENTOR(S) : Yuji Wakatsuki, et al.

It is certified that error appears in the above-identified patent and that said Letters Patent is hereby corrected as shown below:

On the title page:

Column [75] Inventors: Change address of Inventors "Toyaoke, Japan" to --Toyoake, Japan--

Add:--Column [30] Foreign Application Priority Data

June 23, 1989 [JP] Japan ..... 161098/1989--

Signed and Sealed this

Tenth Day of August, 1993

*Attest:*

*Attesting Officer*

Michael K. Kirk

MICHAEL K. KIRK

*Acting Commissioner of Patents and Trademarks*